US005302500A

United States Patent [19]

Irie et al.

[11] Patent Number: 5,302,500

[45] Date of Patent: Apr. 12, 1994

[54] SILVER HALIDE COLOR PHOTOGRAPHIC LIGHT-SENSITIVE MATERIAL OFFERING EXCELLENT HUE REPRODUCTION

[75] Inventors: Yasushi Irie; Hiroshi Shimazaki, both of Hino, Japan

[73] Assignee: Konica Corporation, Tokyo, Japan

[21] Appl. No.: 829,943

[22] Filed: Feb. 3, 1992

[30] Foreign Application Priority Data

Feb. 8, 1991 [JP] Japan ..... 3-060914

[51] Int. Cl.[5] ..... G03C 1/46; G03C 1/08; G03C 7/32

[52] U.S. Cl. ..... 430/505; 430/544; 430/553; 430/570; 430/957

[58] Field of Search ..... 430/505, 544, 553, 583, 430/591, 957, 570

[56] References Cited

U.S. PATENT DOCUMENTS 4,849,325 7/1989 Sasaki et al. ..... 430/505
5,085,979 2/1992 Yamagami et al. ..... 430/505

FOREIGN PATENT DOCUMENTS 283242 9/1988 European Pat. Off. ..... 430/544
384671 8/1990 European Pat. Off. ..... 430/544
451526 10/1991 European Pat. Off. ..... 430/544

*Primary Examiner*—Janet C. Baxter
*Attorney, Agent, or Firm*—Jordan B. Bierman

[57] ABSTRACT

A silver halide color light-sensitive material is disclosed, which-is improved in reproducibility of green color as well as orange color and sky blue color. The light-sensitive material comprises a support and a red-sensitive emulsion layer containing a cyan dye-forming coupler, a green-sensitive emulsion layer containing a magenta dye-forming coupler and a blue-sensitive emulsion layer containing a yellow dye-forming coupler provided on the support. The blue-sensitive silver halide emulsion layer has the maximum spectral sensitivity at a wavelength within the range of 415 nm to 430 nm and a spectral sensitivity of the blue-sensitive emulsion layer at 480 nm is not more than 35% of the maximum spectral sensitivity. The maximum spectral sensitivity and the spectral sensitivity at 480 nm are determined based on a reciprocal of light amount necessary for forming an image density of 0.7 above the minimum density of the blue-sensitive emulsion layer. The blue-sensitive emulsion layer further contains a cyan dye-forming coupler together with the yellow dye-forming coupler.

3 Claims, No Drawings

SILVER HALIDE COLOR PHOTOGRAPHIC LIGHT-SENSITIVE MATERIAL OFFERING EXCELLENT HUE REPRODUCTION

FIELD OF THE INVENTION

The present invention relates to a color photographic light-sensitive material, more specifically a color photographic light-sensitive material which offers high chromaticity and excellent hue reproduction.

BACKGROUND OF THE INVENTION

In recent years, there have been noticeable image quality improvements in silver halide multiple-layered color photographic light-sensitive materials.

Specifically, with respect to recently developed color photographic light-sensitive materials, all of the three major factors of image quality, i.e., graininess, sharpness and color reproduction have reached a fair level. For example, color prints and slide photographs obtained by users in ordinary color photography are not said to be significantly unsatisfactory.

However, with respect to one of the three factors, namely color reproducibility, much remains unsatisfactory as to hue reproduction, though there have been improvements in color purity. For example, blue-green and yellow-green colors are sometimes reproduced into colors by far different from the original color, which may disappoint the user.

The major factors associated with color reproduction include interlayer interimage effect (interimage effect) and spectral sensitivity distribution.

With respect to the interimage effect, the following is known. It is known that a compound which couples with the oxidation product of the color developing agent to form a development inhibitor or precursor thereof is added to a silver halide multiple-layered color photographic light-sensitive material, so that an interimage effect and hence improvement in color reproduction is obtained by retarding the development of other coloring layers with the development inhibitor released from this DIR compound.

Also, in the case of color negative films, it is possible to obtain an effect similar to the interimage effect by using a colored coupler in an amount more than the amount to compensate the undesirable absorption.

These techniques have contributed to improvements in color reproduction, especially color purity. Recently commonly used compounds called diffusible DIR, inhibitors or inhibitor precursor released from which has high diffusibility, have contributed to improvements in color purity significantly. However, the interimage effect is difficult to control with respect to its effective direction, and is faulty in that it causes a hue change, though it improves color purity. Control of interimage effective direction is described in U.S. Pat. No. 4,725,529.

However, when using a large amount of a colored coupler, it becomes very difficult to make a proper judgment for color and density correction at the time of printing because the minimum film density increases, which may often result in print color quality degradation.

On the other hand, with respect to spectral sensitivity, U.S. Pat. No. 3,672,898 discloses an appropriate spectral sensitivity distribution to mitigate color reproduction variation among light sources used in taking pictures.

However, this does not provide any means of improving the poor hue reproduction described above.

Generally speaking, intermediate colors such as blue-green and yellow-green can be exactly reproduced by broadening the wavelength band in which the spectral sensitivity distributions of the blue-, green- and red-sensitive layers overlap, but this leads to color purity degradation inevitably. It is therefore necessary to carefully design a well-balanced combination of spectral sensitivity distribution and interimage effect to obtain improved hue reproduction without degrading color purity. For example, in Japanese Patent Publication Open to Public Inspection No. 34541/1986, which also discloses a method based on a combination of spectral sensitivity distribution and interimage effect, an attempt is made to improve hue reproduction for colors which are difficult to reproduce using color films, and it appears effective to some extent. In a typical example of this method, it is intended to obtain an interimage effect not only from the blue-, green- and red-sensitive layers as conventional but also from a layer other than the conventional color-sensitive layers.

This method appears to be effective to some extent in improving hue reproduction for some colors. However, to ensure the interimage effect, an interimage effect ensuring layer and another kind of light-sensitive silver halide are needed in addition to the essential blue-, green- and red-sensitive layers. In addition, increases in the amount of silver coated and the number of production processes pose a problem of high production cost.

SUMMARY OF THE INVENTION

The object of the present invention is to provide a silver halide color light-sensitive material which is capable of exactly reproducing hues, particularly the hues of green colors without degrading color purity and which offers excellent hue reproduction for orange and blue-sky colors.

The above objects is accomplished by a light-sensitive material comprising a support and a red-sensitive emulsion layer containing a cyan dye-forming coupler, a green-sensitive emulsion layer containing a magenta dye-forming coupler and a blue-sensitive emulsion layer containing a yellow dye-forming coupler provided on the support. The blue-sensitive silver halide emulsion layer has the maximum spectral sensitivity at a wavelength of from 415 nm to 470 nm and a spectral sensitivity of the blue-sensitive emulsion layer at 480 nm is not more than 35% of the maximum spectral sensitivity, and the blue-sensitive emulsion layer further contains a cyan dye-forming coupler together with the yellow dye-forming coupler. The above maximum spectral sensitivity and the spectral sensitivity at 480 nm are each determined based on a reciprocal of light amount necessary for forming an image density of 0.7 above the minimum density of the blue-sensitive emulsion layer.

DETAILED DESCRIPTION OF THE INVENTION

In the present invention, spectral sensitivity distribution is defined as a function of wavelength wherein the light-sensitive material is exposed to spectral light between 400 nm and 700 nm at intervals of several nanometers and its sensitivity is expressed as the reciprocal of the amount of exposure which provides an image having a density higher than the minimum density by 0.7 at each wavelength (hereinafter referred to as spectral sensitivity at an image density of minimum density +0.7).

A preferred mode of embodiment of the light-sensitive material of the present invention is such that the light-sensitive material has at least one blue-sensitive silver halide emulsion layer (hereinafter also referred to as blue-sensitive layer), at least one green-sensitive silver halide emulsion layer (hereinafter also referred to as green-sensitive layer) and at least one red-sensitive silver halide emulsion layer (hereinafter also referred to as red-sensitive layer) on the support in this order from the side opposite to the support.

In the present invention, with respect to the spectral sensitivity distribution in the blue-sensitive layer, it is necessary for the maximum sensitivity wavelength in the to fall in the range from 415 nm to 470 nm and for the sensitivity of the blue-sensitive layer at 480 nm not to exceed 35% of the maximum sensitivity of the same spectral sensitivity distribution. However, for the enhancement of the effect of the invention, it is preferable to make the maximum sensitivity wavelength of the blue-sensitive layer fall in the range from 430 nm to 470 nm and make the ratio of the sensitivity of the same spectral sensitivity distribution at 480 nm not more than 25% of the maximum sensitivity.

The present invention can be embodied as various light-sensitive materials. For example, it can be applied to color negative light-sensitive materials, but these are not to be construed as limitative: similar good hue reproduction can be obtained even when it is applied to color reversal light-sensitive materials.

To obtain the constitution described above for the spectral sensitivity distribution in the blue-sensitive layer of the color photographic light-sensitive material of the present invention, various means can be used. Examples of such means include the method in which a given silver halide is spectrally sensitized with a sensitizing dye having an sensitization spectrum in the desired wavelength band, the method in which the desired spectral sensitivity is obtained by optimizing the halogen composition and/or distribution in the silver halide without using a sensitizing dye, and the method in which an appropriate light absorbent is used in the light-sensitive material to obtain the desired spectral sensitivity distribution. These methods may be used in combination.

Examples of sensitizing dyes which can be used in the blue-sensitive silver halide emulsion layer of the light-sensitive material of the present invention to obtain the spectral sensitivity distribution described above are given below.

The amount of spectral sensitizing dyes added is not subject to limitation; an optimum amount is added to obtain the desired spectral sensitivity distribution.

A-1

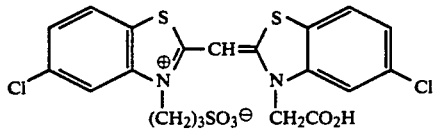

A-2

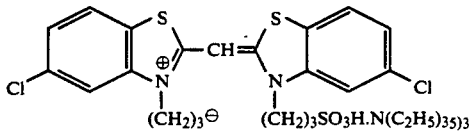

-continued

A-3

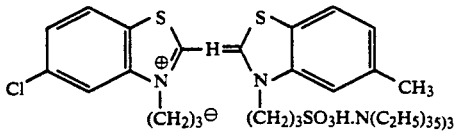

A-4

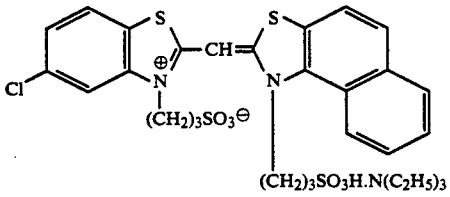

A-5

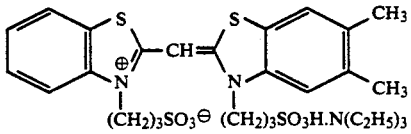

A-6

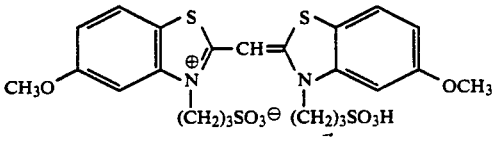

A-7

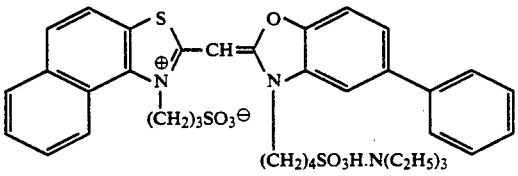

A-8

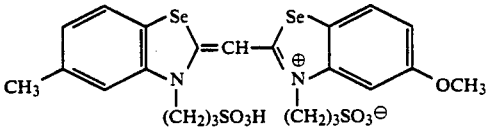

A-9

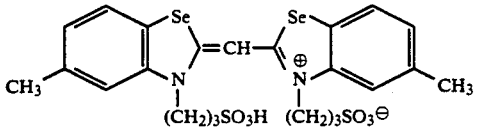

A-10

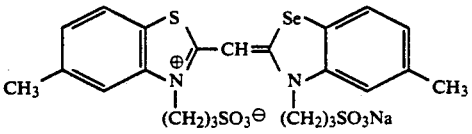

A-11

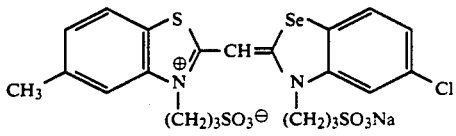

-continued

A-12

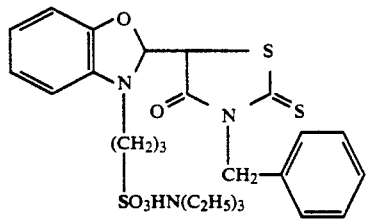

In the present invention, the blue-sensitive layer contains a coupler which forms a cyan dye upon reaction with the oxidation product of the color developing agent (hereinafter referred to as cyan coupler) in addition to a coupler which forms a yellow dye. It is preferable that the cyan coupler in the blue-sensitive layer be used in amounts 0.03 to 0.15 g/m$^2$, more preferably 0.04 to 0.15 g/m$^2$.

Preferred cyan couplers which can be added to the blue-sensitive layer are described below.

The cyan coupler added to the blue-sensitive layer may be a 2-equivalent cyan coupler or a 4-equivalent cyan coupler.

The 2-equivalent cyan coupler added to the blue-sensitive layer is preferably a cyan coupler represented by the following Formula CI.

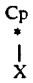

Formula CI wherein Cp represents a coupler moiety; * represents the coupling position of the coupler; X represents a group which is released upon dye formation via coupling with the oxidation product of an aromatic primary amine color developing agent.

Typical examples of the cyan coupler moiety Cp are described in U.S. Pat. Nos. 2,367,531, 2,423,730, 2,474,293, 2,772,162, 2,895,826, 3,002,836, 3,034,892 and 3,041,236 and Agfa Mitteilung (Band II), pp. 156-175 (1961). Of these substances, a phenol or naphthol is preferred.

Examples of the splitting off substituent represented by X include monovalent groups such as halogen atoms, alkoxy groups, aryloxy groups, heterocyclic oxy groups, acyloxy groups, alkylthio groups, arylthio groups, heterocyclic thio groups, groups represented by the formula of

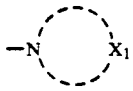

in which $X_1$ represents a group of atoms necessary to form a 5- or 6-membered ring together with the nitrogen atom in the formula and at least one atom selected out of the carbon atom, oxygen atom, nitrogen atom and sulfur atom, acylamino groups and sulfonamide groups, and divalent groups such as alkylene groups; when X is a divalent group, it forms a dimer of the coupler.

Examples of the splitting off substituents are given below.

Halogen atoms:

-continued

Chlorine, bromide, fluorine.

Alkoxy groups:

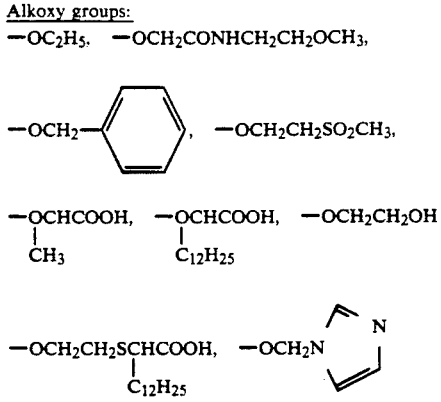

Aryloxy groups:

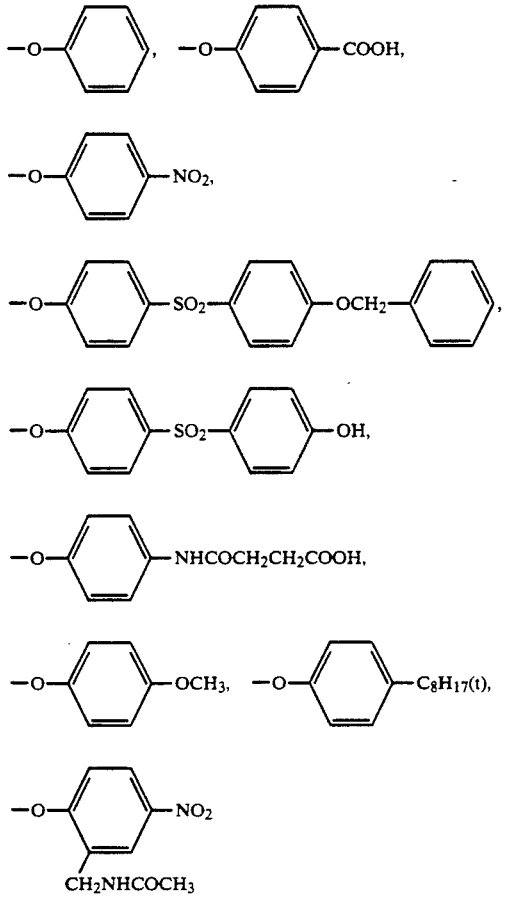

Heterocyclic oxy groups:

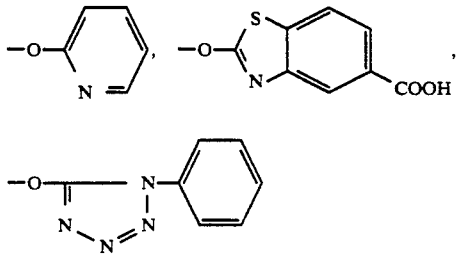

Acyloxy groups:

-continued
$-OCOCH_3$, $-OCOCH{=}CH-$ 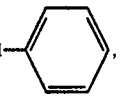 ,
$-OCOC_4H_9$, $-OCO-$ 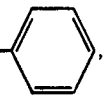 ,
$-OCOCH_2CH_2COOH$
Alkylthio groups:
$-SCH_3$, $-SC_2H_5$, $-SC_8H_{17}$, $-SC_{12}H_{25}$,
$-SCH_2-$ 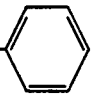 , $-SCH_2CH_2N(C_2H_5)_2$,
$-SCH_2COOC_2H_5$, $-SCH_2CH_2OC_2H_5$,
$-SCH_2CH_2O-$ 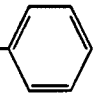
Arylthio groups:
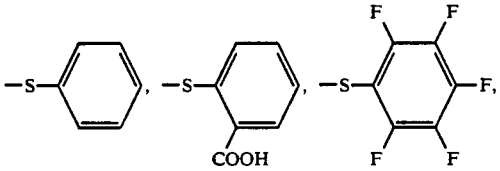
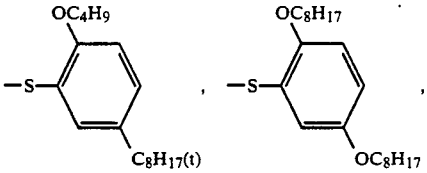
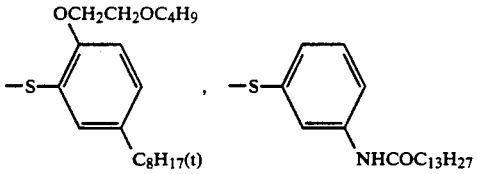
Heterocyclic thio groups:
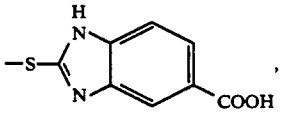 ,
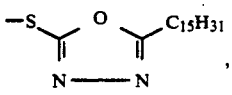 , 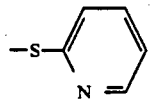
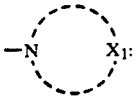
Pyrazolyl group, imidazolyl group, triazolyl group,
-continued
tetrazolyl group, 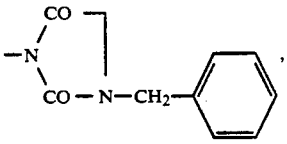 ,
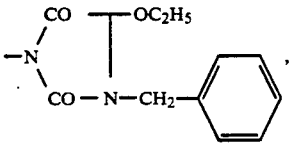 , 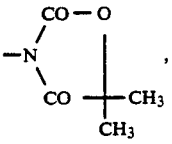 ,
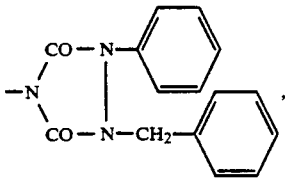 ,
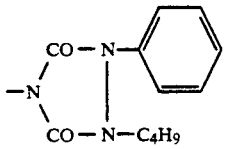 , 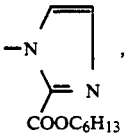 ,
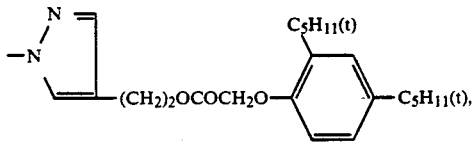
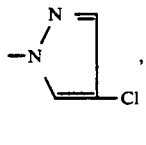 , 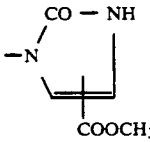 ,
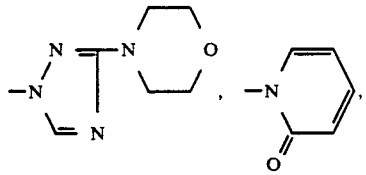 , ,
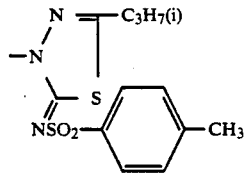
Acylamino groups:
$-NHCOCF_3$, $-NHCO-$ 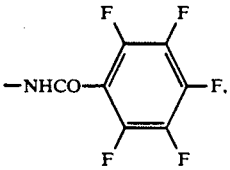 ,
$-NHCO(CF_2CF_2)_2H$, -continued

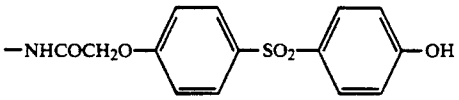

Sulfonamide groups:

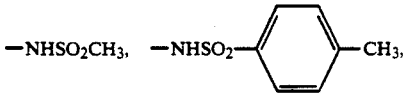

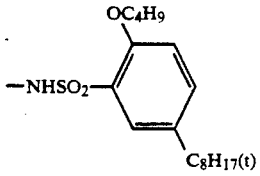

Alkylene groups:

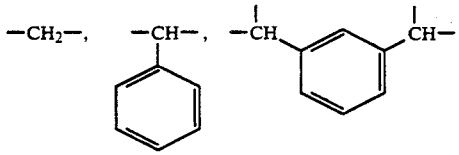

In the present invention, the 2-equivalent cyan coupler contained in the blue-sensitive layer is preferably represented by the following formula CII, CIII or CIV.

Formula CII

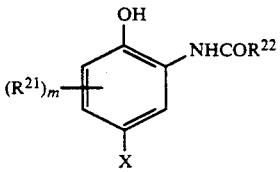

Formula CIII

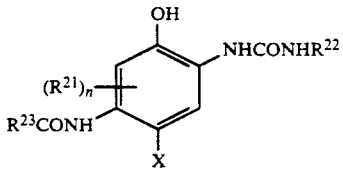

-continued

Formula CIV

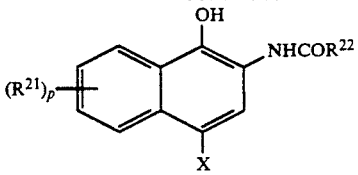

wherein $R^{21}$ represents a substituent; $R^{22}$ and $R^{23}$ independently represent a substituent; m represents an integer of 0 to 3; n represents 0 or 2; p represents 0 to 5; when m, n or p is 2 or more, the $R^{21}$ groups may be identical or not. X has the same definition as with Formula CI.

Examples of the substituent represented by $R^{21}$ include halogen atoms and alkyl, cycloalkyl, aryl and heterocyclic groups which bind directly or via a divalent atom or group.

Examples of the divalent atom or group described above include oxygen atom, sulfur atom, carbonylamino, aminocarbonyl, sulfonylamino, aminosulfonyl, imino, carbonyl, carbonyloxy, oxycarbonyl, ureylene, thioureylene, thiocarbonylmaino, sulfonyl and sulfonyloxy.

Also the alkyl, cycloalkyl, aryl and heterocyclic groups described above include those having a substituent. Examples of the substituent include halogen atoms, nitro, cyano, alkyl, alkenyl, cycloalkyl, aryl, alkoxy, aryloxy, alkoxycarbonyl, aryloxycarbonyl, carboxy, sulfo, sulfamoyl, carbamoyl, acylamino, ureide, urethane, sulfonamido, heterocyclic groups, arylsulfonyl, alkylsulfonyl, arylthio, alkylthio, alkylamino, anilino, hydroxy, imido and acyl.

Examples of $R^{22}$ and $R^{23}$ include alkyl, cycloalkyl, aryl and heterocyclic groups, which include those having a substituent.

With respect to the 2-equivalent cyan couplers represented by Formulas CII through CIV given above, X is exemplified by the same as exemplified for Formula CI above, with preference given to hydrogen atoms, alkoxy groups, aryloxy groups and sulfonamide groups.

With respect to the cyan couplers represented by Formulas CII and CIII, $R^{21}$, $R^{22}$ or X may form a dimer or higher polymer. With respect to the cyan coupler represented by Formula CIV, $R^{21}$, $R^{22}$, $R^{23}$ or X may form a dimer or higher polymer.

Examples of 2-equivalent cyan couplers which can be used for the present invention are given below. 2-equivalent cyan couplers:

$C_2$-1

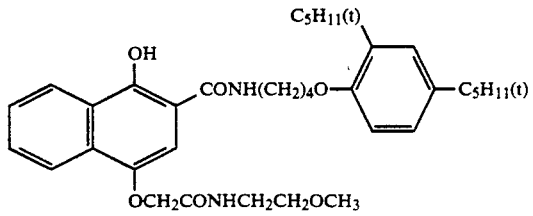

-continued
$C_2$-2
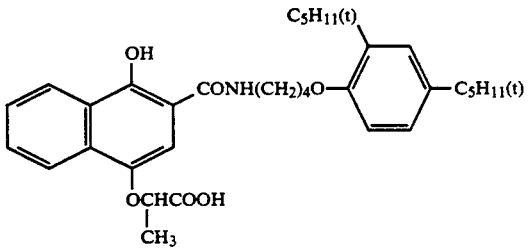
$C_2$-3
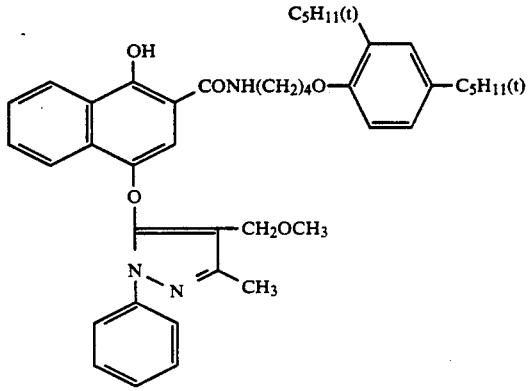
$C_2$-4
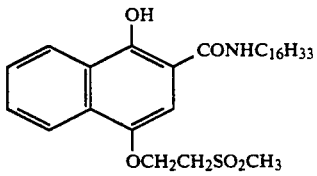
$C_2$-5
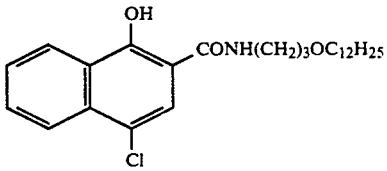
$C_2$-6
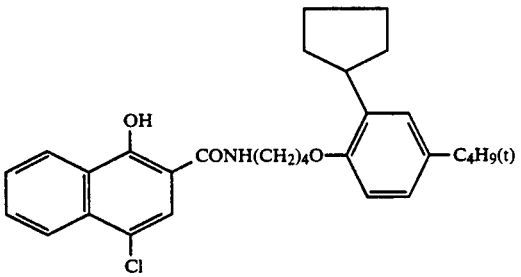
$C_2$-7
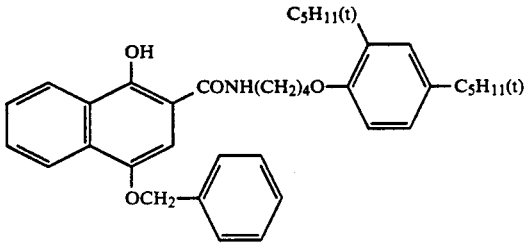

-continued
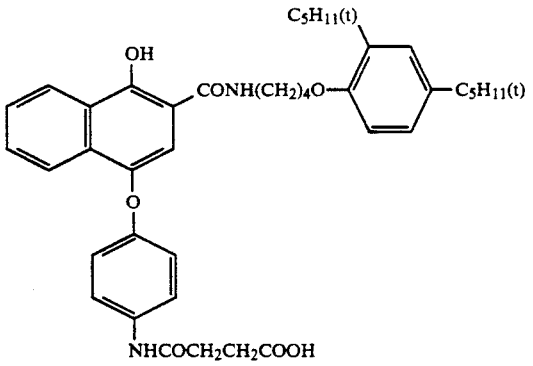
$C_2$
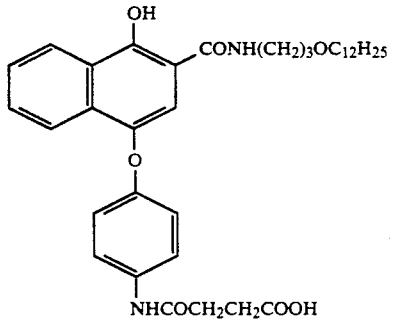
$C_2$-9
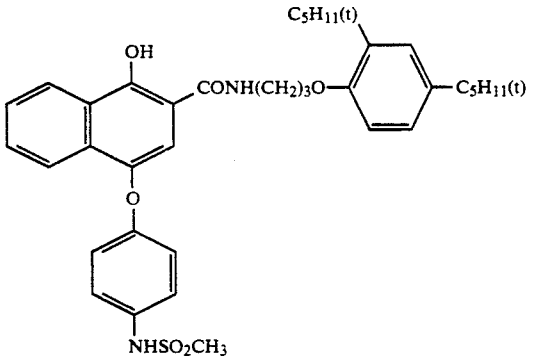
$C_2$-10
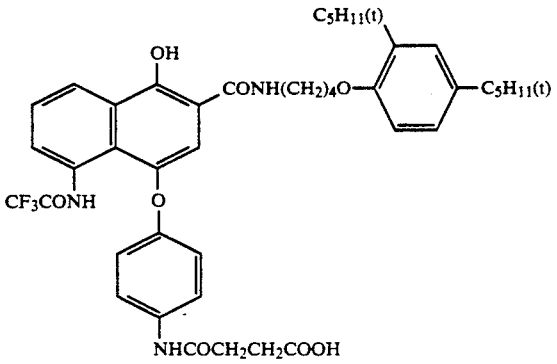
$C_2$-11

-continued
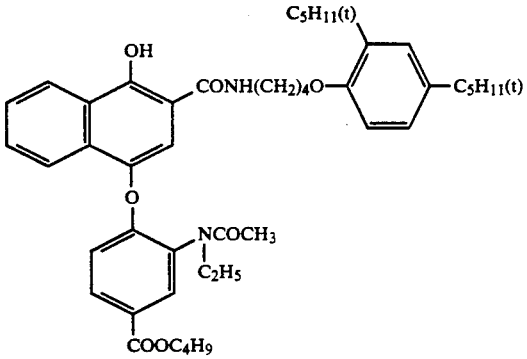
$C_2$-12
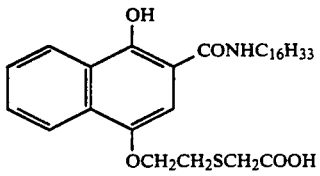
$C_2$-13
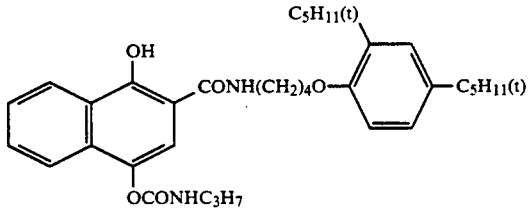
$C_2$-14
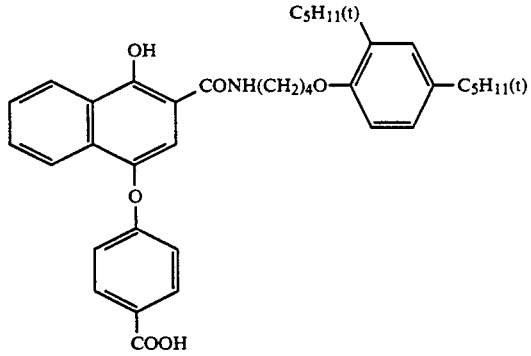
$C_2$-15
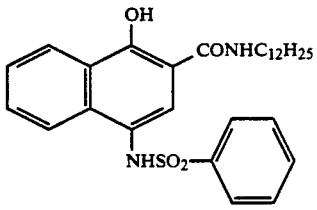
$C_2$-16
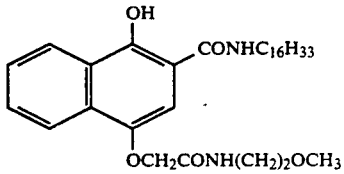
$C_2$-17

-continued
$C_2$-18
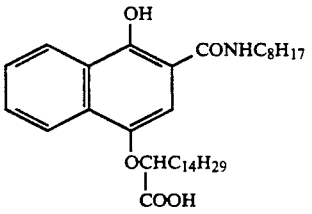
$C_2$-19
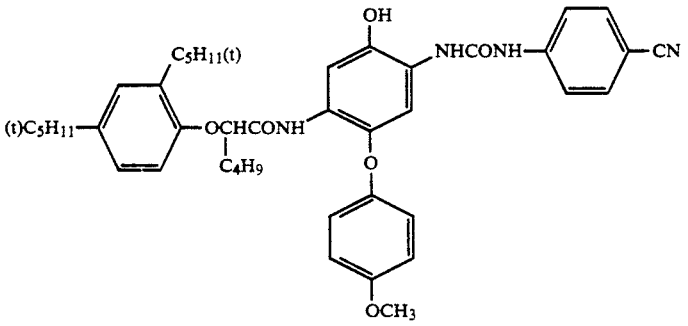
$C_2$-20
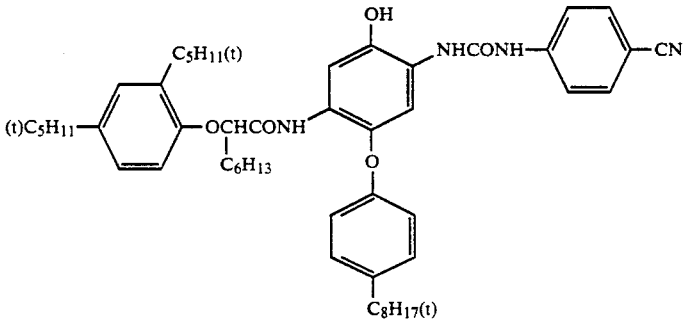
$C_2$-21
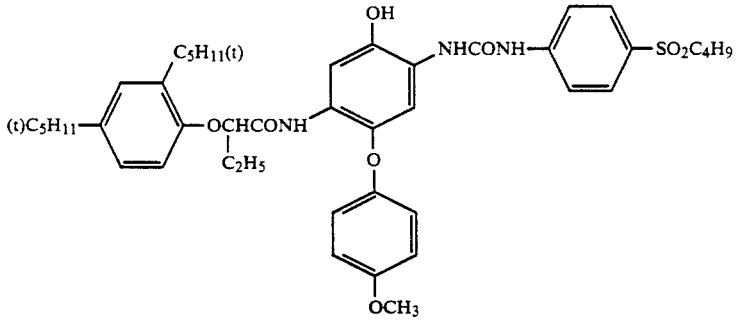
$C_2$-22
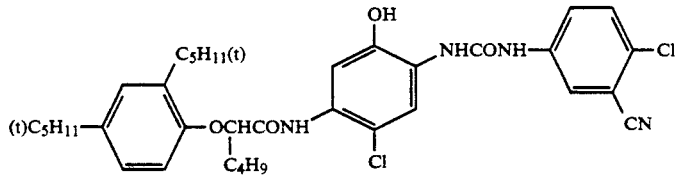
$C_2$-23
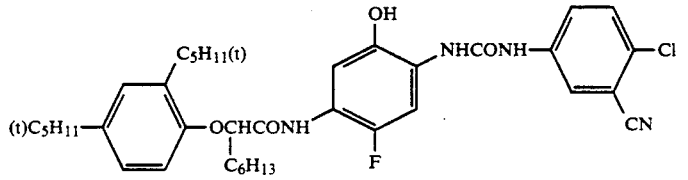

-continued
$C_2$-24
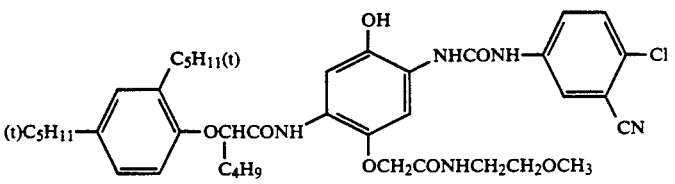
$C_2$-25
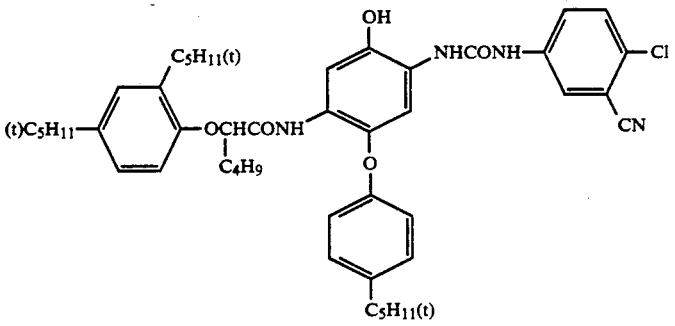
$C_2$-26
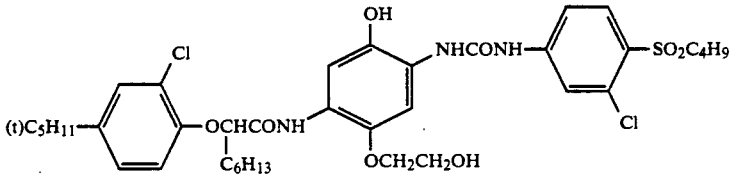
$C_2$-27
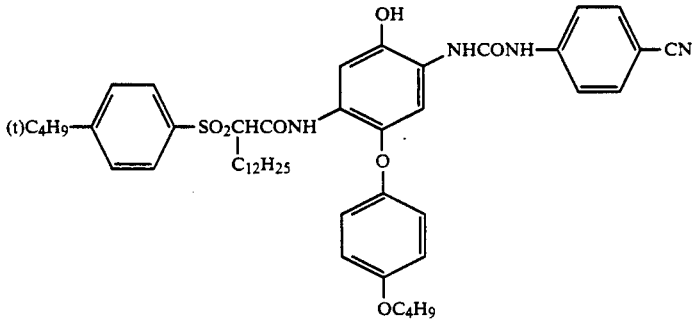
$C_2$-28
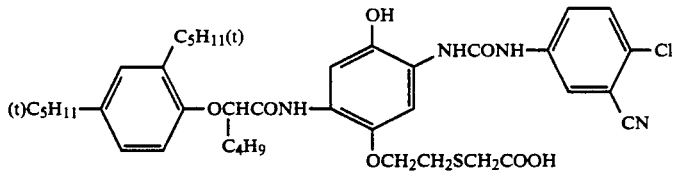
$C_2$-29
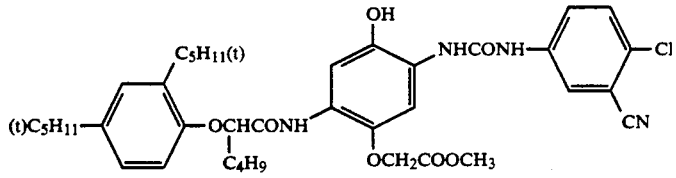
$C_2$-30
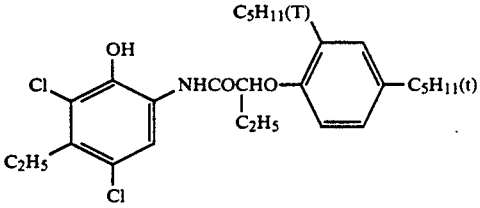

-continued

C2-31

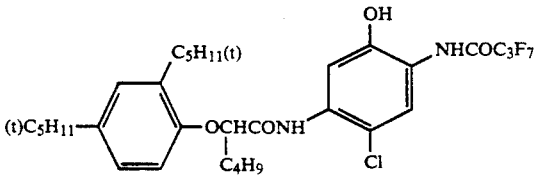

C2-32

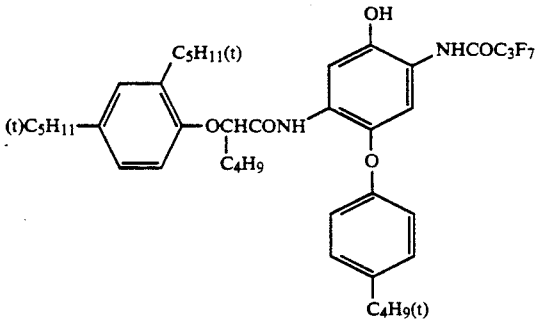

C2-33

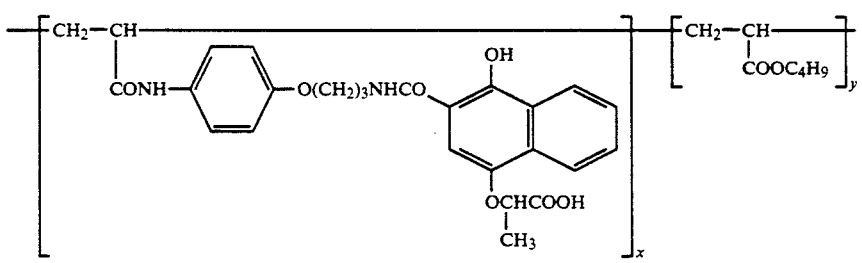

x:y = 40:60

C2-34

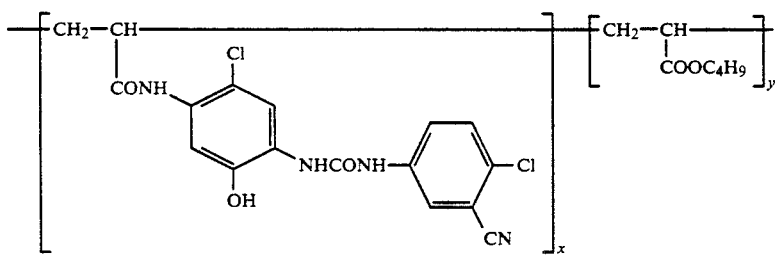

x:y = 50:50

Next, 4-equivalent couplers which can be used in the blue-sensitive layer for the present invention are described below.

The 4-equivalent coupler has no substituent at the coupling position and is preferably a phenol or naphthol.

More preferable 4-equivalent couplers are those represented by Formulas CII through CIV given above wherein X at the coupling position is a hydrogen atom. In this case, examples of $R^{21}$ through $R^{23}$ include the examples given with respect to Formulas CII through CIV above, including those wherein a dimer or higher polymer is formed at $R^{21}$ through $R^{23}$.

Examples of 4-equivalent couplers which can be used for the present invention are given below.

4-equivalent cyan couplers:

C4-1

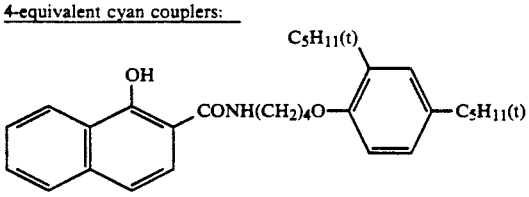

C4-2

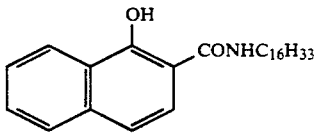

-continued
4-equivalent cyan couplers:
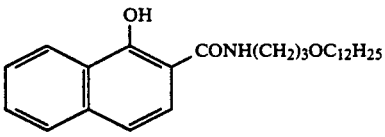
C4-3
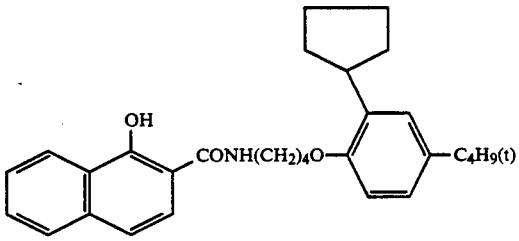
C4-4
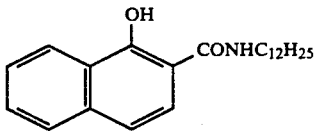
C4-5
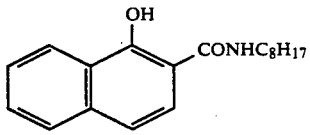
C4-6
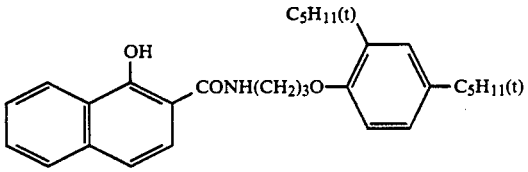
C4-7
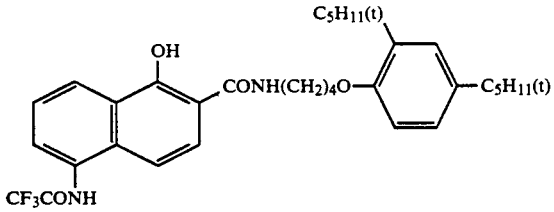
C4-8
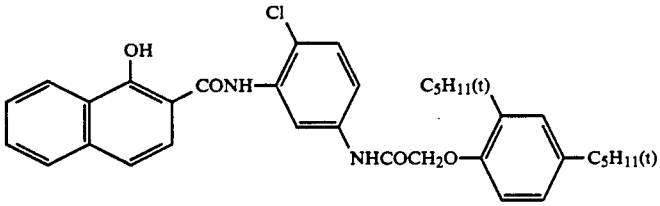
C4-9
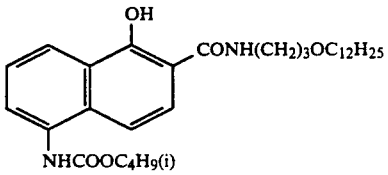
C4-10

-continued
4-equivalent cyan couplers:
C4-11
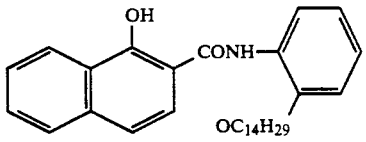
C4-12
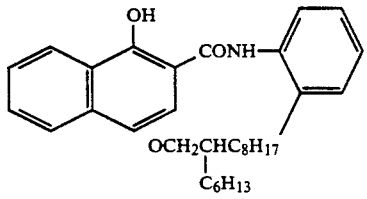
C4-13
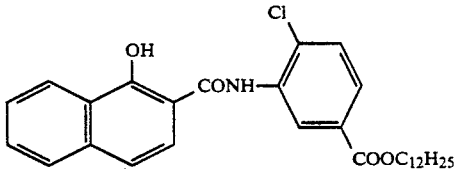
C4-14
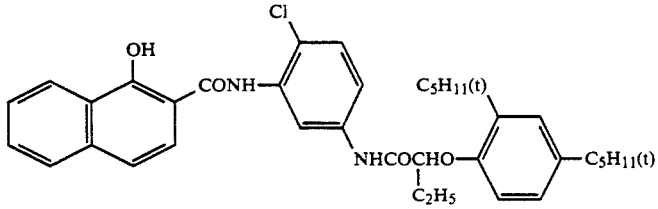
C4-15
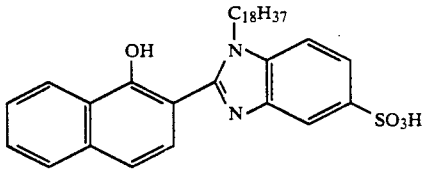
C4-16
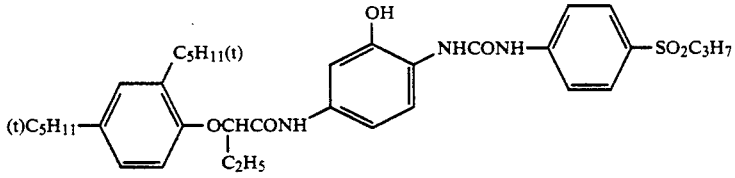
C4-17
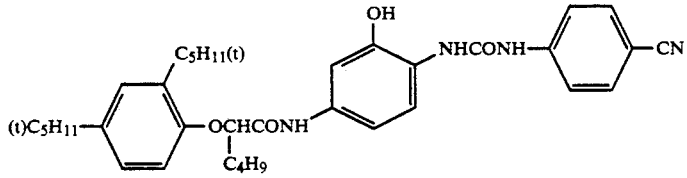
C4-18
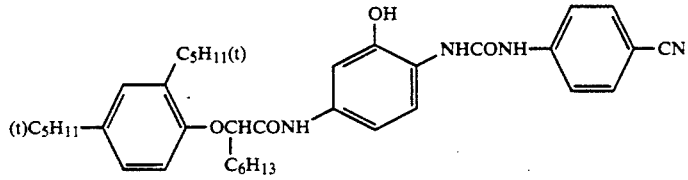

-continued
4-equivalent cyan couplers:
C4-19
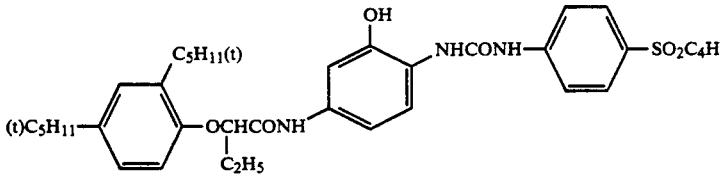
C4-20
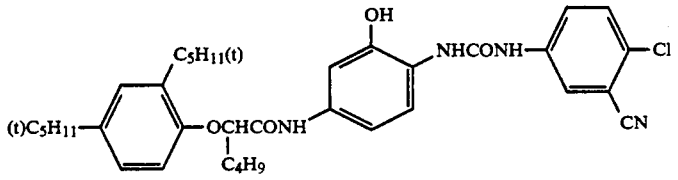
C4-21
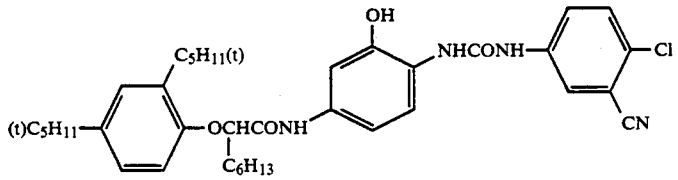
C4-22
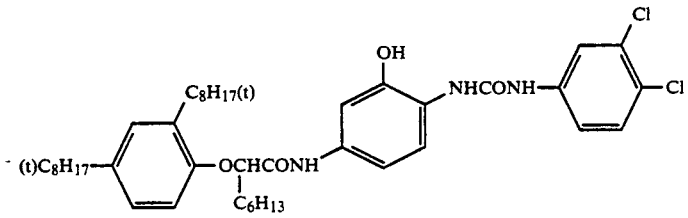
C4-23
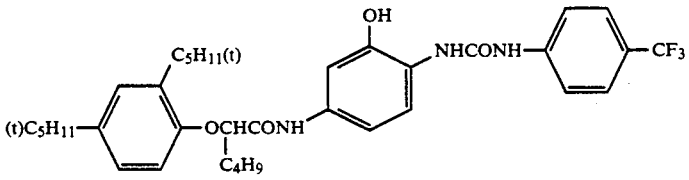
C4-24
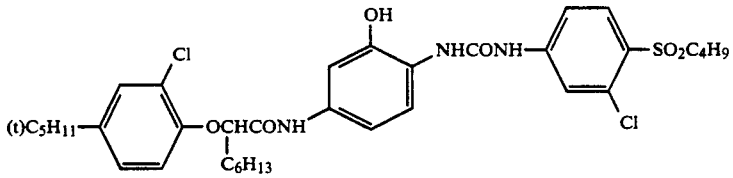
C4-25
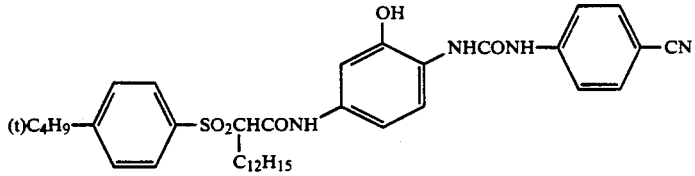
C4-26
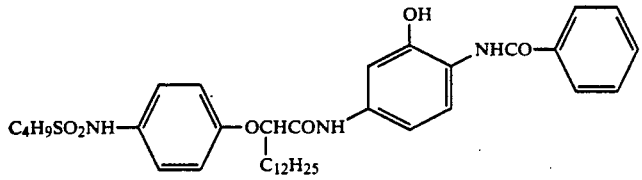

-continued 4-equivalent cyan couplers:

C4-27

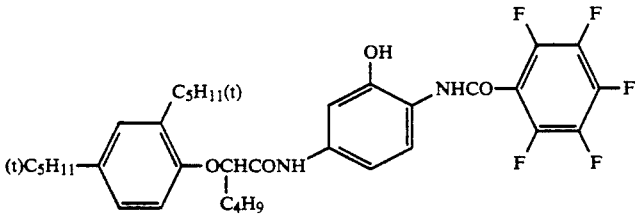

C4-28

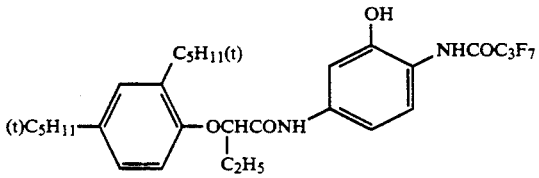

C4-29

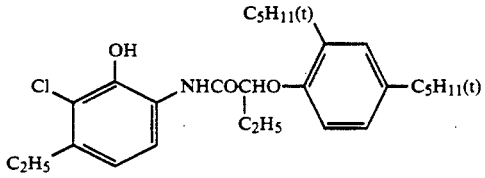

C4-30

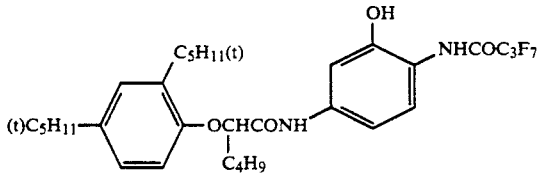

C4-31

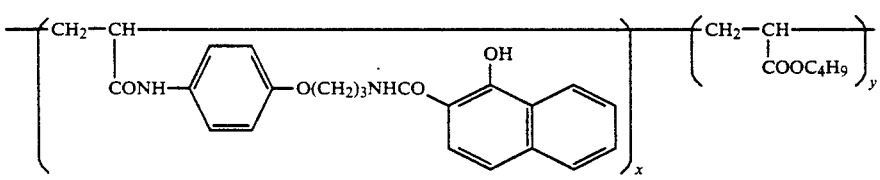

x:y = 40:60 (ratio by weight)

C4-32

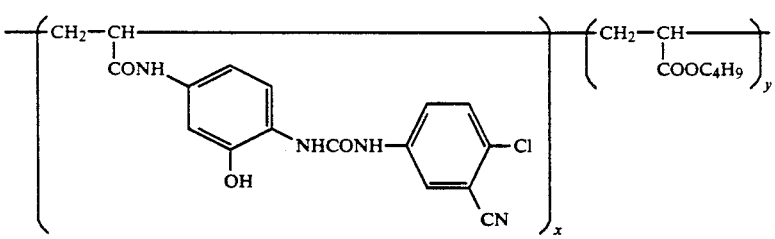

x:y = 50:50 (ratio by weight)

Furthermore, the blue-sensitive layer may incorporate the following diffusive DIR couplers, which are included in the scope of cyan couplers described above in a broader sense.

The diffusive DIR coupler usable in the present invention is a cyan dye forming coupler capable of releasing a development inhibitor or its precursor, which are diffusive in developing process, upon coupling reaction with the oxidation product of a developing agent. The diffusibility of the development inhibitor or its precursor splitted off from coupler moiety of DIR coupler is preferably in the range of 0.34 to 0.6, more preferably 0.40 to 0.6.

The diffusibility can be examined as follows.

Light sensitive material samples (Samples I and II) were produced by the following method.

Sample I: Sample having a green-sensitive silver halide emulsion layer

On a transparent support, a gelatin coating solution containing silver iodobromide grains that had been spectrally sensitized to green (silver iodide content: 6 mol %, average grain size: 0.48 μm) and the following coupler (amount: 0.07 mol per mol silver) was applied in such a manner that the contents of silver and gelatin in the resulting layer became 1.1 g/m$^2$ and 3.0 g/m$^2$, respectively. On this layer, a protective layer was provided by applying a gelatin coating solution containing silver iodobromide that had not been subjected to spectral and chemical sensitization (silver iodide content: 2 mol %, average grain size: 0.08 μm) in such a manner that the contents of silver and gelatin in the resulting layer became 0.1 g/m² and 0.8 g/m², respectively.

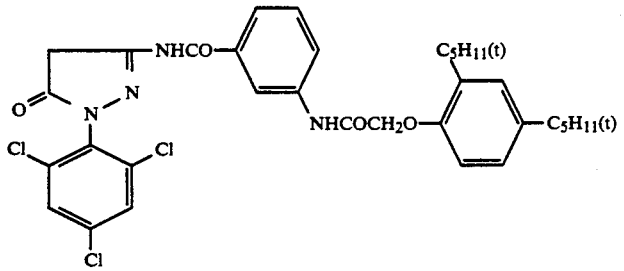

Sample II: This sample was prepared in substantially the same manner as in the preparation of Sample I except that silver iodobromide was not used for the protective layer.

In each layer of Samples I and II, additives such as a gelatin hardener and a surfactant were added.

Each sample was exposed to white light through an optical wedge, and processed according to the following procedure. Two developers were employed; one contained various development inhibitors in such amounts as would make the sensitivity of Sample II 60% ($-\Delta\log E=0.22$), and the other contained no development inhibitors.

| Processing procedure (at 38° C.) | |
|---|---|
| Color developing | 2 min 40 sec |
| Bleaching | 6 min 30 sec |
| Rinsing | 3 min 15 sec |
| Fixing | 6 min 30 sec |
| Rinsing | 3 min 15 sec |
| Stabilizing | 1 min 30 sec |
| Drying | |

The processing liquids employed had the following compositions.

| <Color Developer> | |
|---|---|
| 4-amino-3-methyl-N-ethyl-N-(-hydroxyethyl)-aniline sulfate | 4.75 g |
| Anhydrous sodium sulfite | 4.25 g |
| Hydroxyl amine ½ sulfate | 2.0 g |
| Anhydrous potassium carbonate | 37.5 g |
| Sodium bromide | 1.3 g |
| Trisodium nitrilotriacetate (monohydrate) | 2.5 g |
| Potassium hydroxide | 1.0 g |

-continued

| | |
|---|---|
| Water was added to make the total quantity 1 l. | |
| <Bleacher> | |
| Ferric ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |

Water was added to make the total quantity 1 l, and pH was adjusted to 6.0 with aqueous ammonia.

| | |
|---|---|
| <Fixer> | |
| Ammonium thiosulfate | 175.0 g |
| Anhydrous sodium sulfite | 8.5 g |
| Sodium metasulfite | 2.3 g |
| Water was added to make the total quantity 1 l, and pH was adjusted to 6.0 with acetic acid. | |
| <Stabilizer> | |
| Formalin (aqueous 37% solution) | 1.5 ml |
| Koniducks (manufactured by Konica Corp) | 7.5 ml |

Water was added to make the total quantity 1 l. Then, the sensitivity of each sample was measured.

The diffusibility of a development inhibitor is expressed by the following formula:

Desensitization degree of Sample I $\Delta S=S_O-S_I$

Desensitization degree of Sample II $\Delta S_O=S_O'-S_{II}$

Diffusibility $=\Delta S/\Delta S_O$ wherein $S_O$ is the sensitivity of Sample I which was obtained when development was performed with the developer containing no development inhibitors; $S_O'$ is the sensitivity of Sample II; $S_I$ is the sensitivity of Sample I obtained when development was performed with the developer containing development inhibitors; $S_{II}$ is the sensitivity of Sample II. Here, the sensitivity is the logarithm of the reciprocal of an exposure required for obtaining a density higher than the fogging density by 0.3.

A variety of development inhibitors were examined for diffusibility by the above method. The results are shown in Tables 1 and 2.

TABLE 1

| Structure | Amount added mol/l | Desensitization degree $\Delta S_0$ | Desensitization degree $\Delta S$ | Diffusibility $\Delta S/\Delta S_0$ |
|---|---|---|---|---|
| 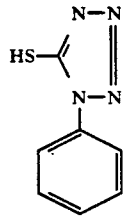 | $1.3\times10^{-5}$ | 0.22 | 0.05 | 0.23 |

TABLE 1-continued

| Structure | Amount added mol/l | Desensitization degree $\Delta S_0$ | $\Delta S$ | Diffusibility $\Delta S/\Delta S_0$ |
|---|---|---|---|---|
| 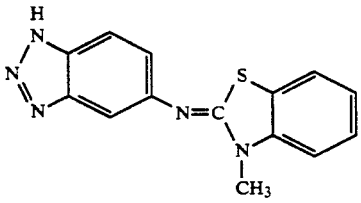 | $1.3 \times 10^{-5}$ | 0.23 | 0.03 | 0.34 |
| 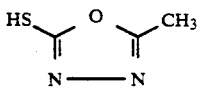 | $2.5 \times 10^{-5}$ | 0.22 | 0.10 | 0.45 |
| 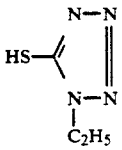 | $3.0 \times 10^{-5}$ | 0.21 | 0.10 | 0.48 |

TABLE 2

| Structure | Amount added mol/l | Desensitization degree $\Delta S_0$ | $\Delta S$ | Diffusibility $\Delta S/\Delta S_0$ |
|---|---|---|---|---|
| 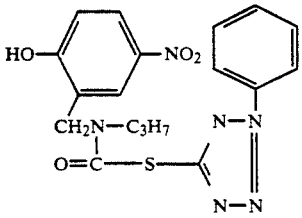 | $1.4 \times 10^{-5}$ | 0.23 | 0.11 | 0.48 |
| 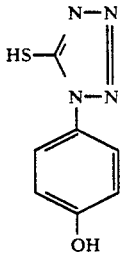 | $2.5 \times 10^{-5}$ | 0.22 | 0.13 | 0.59 |
| 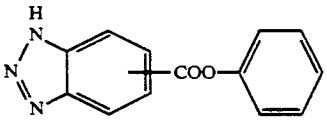 | $3.5 \times 10^{-5}$ | 0.23 | 0.15 | 0.65 |
| 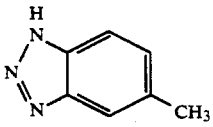 | $4.3 \times 10^{-5}$ | 0.22 | 0.16 | 0.73 |
| 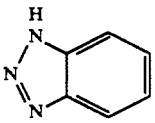 | $1.7 \times 10^{-4}$ | 0.21 | 0.20 | 0.95 |

In the invention, any kinds of DIR compound can be employed as long as it can release a development inhibitor with a diffusibility of 0.34 or higher.

Representative examples of the DIR compounds usable in the invention are given below.

Formula D-1

*A—(Y)m* wherein A represents a cyan coupler moiety; m represents 1 or 2; and Y represents a group that is linked to the coupling site of A and capable of being released upon a coupling reaction with an oxidation developing agent to form a development inhibitor or a group capable of releasing a development inhibitor which has a diffusibility of 0.40 or higher. As the cyan coupler moiety, residue of a cyan coupler such as above-mentioned can be used.

Examples of the groups represented by Y are given below.

Formula D-2

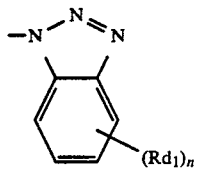

Formula D-3

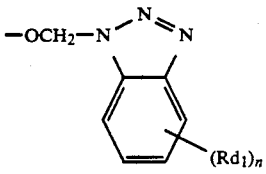

Formula D-4

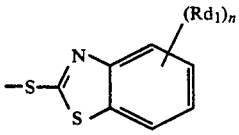

Formula D-5

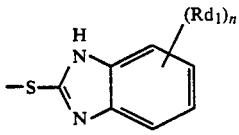

Formula D-6

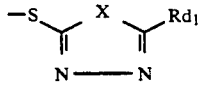

Formula D-7

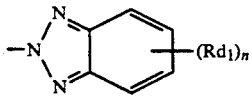

Formula D-8

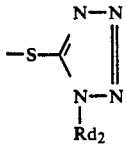

Formula D-9

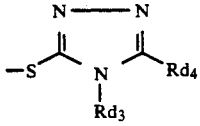

In the above formulae, $Rd_1$ represents hydrogen, halogen, alkyl, alkoxy, acylamino, alkoxycarbonylthiazolideneamino, aryloxycarbonyl, acyloxy, carbamoyl, N-alkylcarbamoyl, N,N-dialkylcarbamoylnitro, amino, N-arylcarbamoyloxy, sulfamoyl, N-alkylcarbamoyloxy, hydroxy, alkoxycarbonylamino, alkylthio, arylthio, aryl, heterocyclic, cyano, alkylsulfonyl or aryloxycarbonylamino group, n represents 0, 1 or 2. when n is 2, $Rd_1$s may be either identical or different, and the total number of carbon atoms contained in $Rd_1$ or $Rd_1$s is 0 to 10.

In the formula D-6, $Rd_1$ contains 0 to 15 carbon atoms.

In the formula D-6, X represents oxygen or sulfur. In the formula D-8, $Rd_2$ represents alkyl, aryl or a heterocyclic group.

In the formula D-9, $Rd_3$ represents hydrogen atom or alkyl, cycloalkyl, aryl or a heterocyclic group and $Rd_4$ represents hydrogen, halogen atom or alkyl, cycloalkyl, aryl, acylamino, alkoxycarbonylamino, aryloxycarbonylamino, alkanesulfamido, cyano, heterocyclic, alkylthio or amino group.

When $Rd_1$, $Rd_2$, $Rd_3$ or $Rd_4$ is alkyl, it may be a straight-chain or branched alkyl that may have a substituent.

$Rd_1$, $Rd_2$, $Rd_3$ and $Rd_4$ each may have a substituent when they are aryl.

When $Rd_1$, $Rd_2$, $Rd_3$ or $Rd_4$ is a heterocyclic group, it may have a substituent. Preferred heterocyclic groups are 5- or 6-membered single or condensed rings each containing at least one hetero atom selected from nitrogen, oxygen and sulfur. Representative examples of such heterocyclic groups include pyridyl, quinolyl, furyl, benzothiazolyl, oxazolyl, imidazolyl, thiazolyl, triazolyl, benzotriazolyl, imide and oxazine.

In the formulae D-6 to D-8, $Rd_1$ and $Rd_2$ contain 0 to 15 carbon atoms in total.

In the formula D-9, the total number of carbon atoms contained in $Rd_3$ and $Rd_4$ is 0 to 15.

Formula D-10

*—TIME—INHIBIT* wherein TIME represents a group which is linking to the coupling site of A, and is capable of being split off from the coupler upon a reaction between the coupler and an oxidation product of color developing agent, and is capable of releasing an INHIBIT group with control after being split off from the coupler; and INHIBIT represents a group that can become a development inhibitor after being released from TIME (e.g. a group represented by any one of the formulae D-2 to D-9).

Representative examples of —TIME—INHIBIT are given below.

Formula D-11

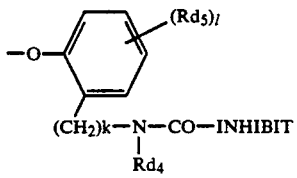

Formula D-12

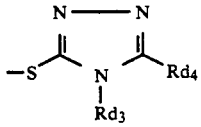

-continued

Formula D-13

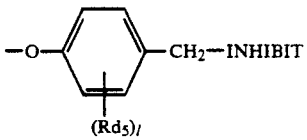

Formula D-14

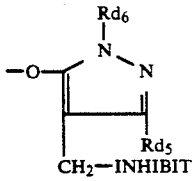

Formula D-15

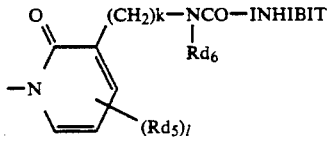

Formula D-16

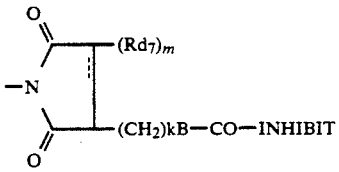

Formula D-17

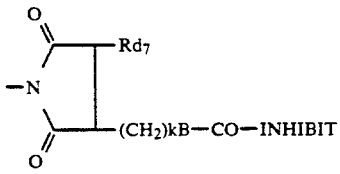

Formula D-18

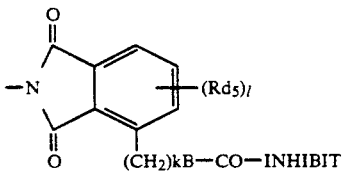

Formula D-19

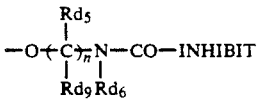

In the formulae D-11 to 15, and D-18, $Rd_5$ represents hydrogen or halogen atom or, alkyl, cycloalkyl, alkenyl, aralkyl, alkoxy, alkoxycarbonyl, anilino, acylamino, ureide, cyano, nitro, sulfoneamide, sulfamoyl, carbamoyl, aryl, carboxy, sulfo, hydroxy or alkanesulfonyl group. In the formulae D-11 to 13, D-15 and D-18, $Rd_5$s may combine with each other to form a condensed ring. In the formula D-11, D-14, D-15 and D-19, $Rd_6$ represents alkyl, alkenyl, aralkyl, cycloalkyl, a heterocyclic group or aryl group. In the formula D-16 and 17, $Rd_7$ represents hydrogen atom or, alkyl, alkenyl, aralkyl, cycloalkyl, a heterocyclic group or aryl group. In the formula D-19, $Rd_8$ and $Rd_9$ each represent hydrogen or alkyl group, preferably alkyl group with 1 to 4 carbon atoms. In the formulae D-11, D-15 to 18, k represents an integer of 0, 1 or 2. In the formulae D-11 to 13, D-15 and D-18, l represents an integer of 1 to 4. In the formula D-16, m is an integer of 1 or 2. When m is 2, $Rd_7$s may be either identical or different. In the formula D-19, n represents an integer of 2 to 4. $Rd_8$s may be identical or different, and the same is true of $Rd_9$s. In the formulae D-16 to 18, B represents oxygen atom or —$NRd_6$—, $Rd_6$ is as defined above. In the formula D-16, the double line consisting of a solid line and a dashed line means the bond may be either a single bond or a double bond. In the case of a single bond, m is 2, and in the case of a double bond, m is 1. INHIBIT has the same meaning as in the formulae D-2 to 9, except for the number of carbon atoms.

As stated above, INHIBIT is a group represented by any one of the formulae D-2 to 9. In the formulae D-2 to 7, the total number of carbon atoms contained in $Rd_1$ of each molecule is 0 to 15. In the formula D-8, the total number of carbon atoms contained in $Rd_2$ is 1 to 15, and in the formula D-9, the total number of carbon atoms contained in $Rd_3$ and $Rd_4$ is 0 to 15.

$Rd_5$, $Rd_6$ and $Rd_7$ each may have a substituent when they are alkyl, aryl or cycloalkyl group.

Of the diffusible DIR compounds represented by the formula D-1, preferred are those in which Y is a group represented by the formula D-2, D-3 or D-10. Of diffusible DIR compounds represented by the formula D-1 in which Y is a group represented by the formula D-10, preferred are those in which INHIBIT is a group represented by the formula D-2, D-6, especially preferable is the case when X is oxygen atom, or D-8 especially preferable is the case when $Rd_2$ is hydroxyaryl or $C_{1-5}$ alkyl group.

Preferred examples of diffusible cyan DIR coupler include those represented by any one of the following structural formulae and those given in Tables 3.

TABLE 3

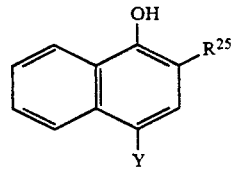

| Example compound No. | $R^{25}$ | Y |
|---|---|---|
| $C_D$-1 | (1) | (6) |
| $C_D$-2 | (1) | (7) |
| $C_D$-3 | (2) | (8) |
| $C_D$-4 | (4) | (9) |
| $C_D$-5 | (2) | (10) |
| $C_D$-6 | (2) | (11) |
| $C_D$-7 | (2) | (12) |
| $C_D$-8 | (2) | (13) |
| $C_D$-9 | (3) | (14) |
| $C_D$-10 | (5) | (15) |
| $C_D$-11 | (5) | (16) |
| $C_D$-12 | (2) | (17) |
| $C_D$-13 | (2) | (18) |

$-CONHC_{13}H_{37}$, (1)

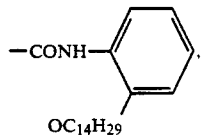

(2)

-continued
(3)
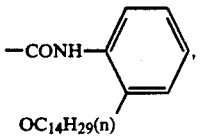
(4)
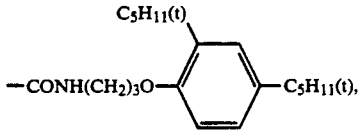
(5)
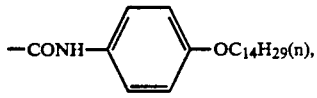
(6)
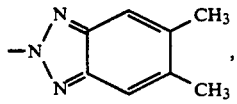
(7)
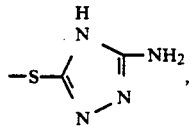
(8)
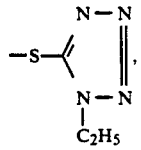
(9)
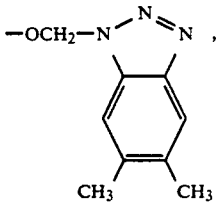
(10)
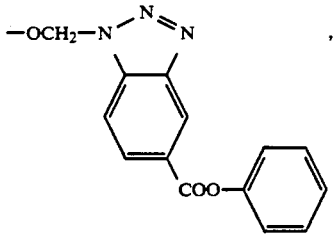
(11)
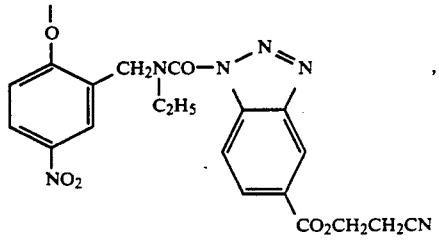
-continued
(12)
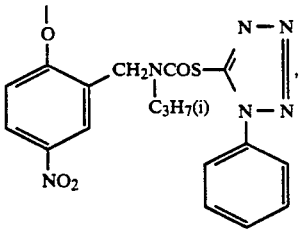
(13)
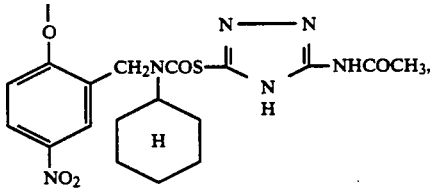
(14)
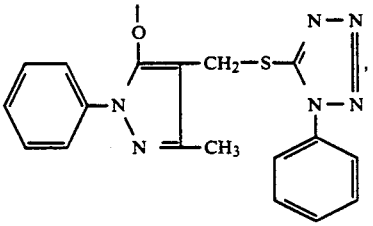
(15)
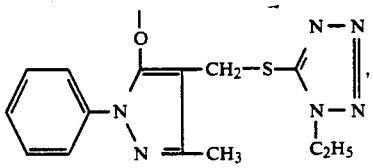
(16)
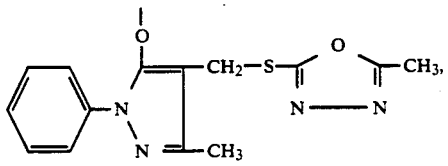
(17)
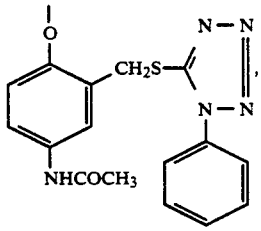
(18)
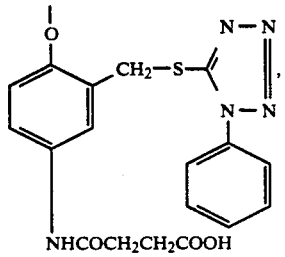

Of the couplers described above, diffusive DIR cyan couplers are desirable as cyan couplers to be added to the blue-sensitive layer. The amount of the diffusive DIR cyan coupler to be added to the blue sensitive layer is preferably 0.04 to 0.1 g/m$^2$, more preferably 0.03 to 0.1 g/m$^2$.

The silver halide emulsion used in the color light-sensitive material of the present invention may be chemically sensitized by an ordinary method.

The silver halide emulsion may be formulated with an antifogging agent, a stabilizer and other additives. It is advantageous to use gelatin as the binder for the emulsion, though this is not to be construed as limitative.

The emulsion layer and other hydrophilic colloidal layers may be hardened, and may also contain a plasticizer and a dispersion or latex of a synthetic polymer which is insoluble or sparingly soluble in water.

The emulsion layer of the color photographic light-sensitive material of the present invention generally incorporates a color developing coupler. It is also possible to use a colored coupler and competitive coupler having a corrective effect, and a chemical substance which couples with the oxidation product of the developing agent and releases a photographically useful fragment such as a development accelerator, bleach accelerator, developer, silver halide solvent, toning agent, hardener, fogging agent, antifogging agent, chemical sensitizer, spectral sensitizer and desensitizer.

The light-sensitive material may be provided with an auxiliary layer such as a filter layer, anti-halation layer or anti-irradiation layer. In these layers and/or emulsion layer, a dye may be contained which oozes out from the light-sensitive material or is bleached during the developing process.

The light-sensitive material may be formulated with a formalin scavenger, a brightener, a matting agent, a lubricant, an image stabilizer, a surfactant, an anti-stain agent, a development accelerator, a development retarder and a bleach accelerator.

Any substance can be used as the support such as polyethylene-laminated paper, polyethylene terephthalate films, baryta paper and cellulose triacetate film.

A dye image can be obtained using the color light-sensitive material of the present invention by carrying out an ordinary color photographic process after exposure.

EXAMPLES

In all the following examples, the amount of addition to the silver halide photographic light-sensitive material is expressed in gram per m$^2$, unless otherwise specified. Also, the amount of silver halide and colloidal silver is expressed as the amount of silver. With respect to sensitizing dyes, the amount is expressed in molar number per mol of silver halide in the same layer.

EXAMPLE 1

Layers having the following compositions were formed on a triacetyl cellulose film support in this order from the support side to yield a multiple-layered color photographic light-sensitive material sample No. 101.

| Sample No. 101 | |
|---|---|
| Layer 1: Anti-halation layer | |
| Black colloidal silver | 0.18 |
| UV absorbent UV-1 | 0.23 |
| High boiling solvent Oil-1 | 0.20 |
| Gelatin | 1.46 |
| Layer 2: Interlayer | |
| Gelatin | 1.30 |
| Layer 3: Low speed red-sensitive emulsion layer | |
| Silver iodobromide emulsion Em-1 (average grain size 0.27 μm, average silver iodide content 4 mol %) | 0.80 |
| Sensitizing dye SD-1 | $8.0 \times 10^{-4}$ |
| Sensitizing dye SD-2 | $6.4 \times 10^{-4}$ |
| Cyan coupler C-1 | 0.60 |
| Colored cyan coupler CC-1 | 0.10 |
| DIR compound CD-11 | 0.05 |
| DIR compound CD-9 | 0.004 |
| High boiling solvent Oil-1 | 0.50 |
| Gelatin | 0.90 |
| Layer 4: High speed red-sensitive emulsion layer | |
| Silver iodobromide emulsion Em-2 (average grain size 0.38 μm, average silver iodide content 6 mol %) | 1.00 |
| Sensitizing dye SD-1 | $2.5 \times 10^{-4}$ |
| Sensitizing dye SD-2 | $2.0 \times 10^{-4}$ |
| Cyan coupler C-1 | 0.10 |
| Colored cyan coupler CC-1 | 0.01 |
| DIR compound CD-11 | 0.03 |
| DIR compound CD-9 | 0.005 |
| High boiling solvent Oil-1 | 0.15 |
| Gelatin | 0.90 |
| Layer 5: Interlayer | |
| Anti-color staining agent SC-1 | 0.10 |
| High boiling solvent Oil-2 | 0.10 |
| Gelatin | 1.00 |
| Layer 6: Low speed green-sensitive emulsion layer | |
| Silver iodobromide emulsion Em-1 (average grain size 0.27 μm, average silver iodide content 4 mol %) | 0.80 |
| Sensitizing dye SD-2 | $8.5 \times 10^{-5}$ |
| Sensitizing dye SD-3 | $8.0 \times 10^{-4}$ |
| Magenta coupler M-1 | 0.53 |
| Colored magenta coupler CM-2 | 0.09 |
| DIR compound DD-1 | 0.005 |

-continued

| | |
|---|---|
| DIR compound CD-9 | 0.01 |
| High boiling solvent Oil-2 | 0.70 |
| Gelatin | 1.30 |
| Layer 7: High speed green-sensitive emulsion layer | |
| Silver iodobromide emulsion Em-2 (average grain size 0.38 μm, average silver iodide content 6 mol %) | 0.90 |
| Sensitizing dye SD-4 | $3.5 \times 10^{-4}$ |
| Sensitizing dye SD-5 | $2.0 \times 10^{-4}$ |
| Magenta coupler M-1 | 0.17 |
| Colored magenta coupler CM-1 | 0.06 |
| DIR compound DD-1 | 0.05 |
| DIR compound CD-9 | 0.004 |
| High boiling solvent Oil-2 | 0.40 |
| Gelatin | 0.80 |
| Layer 8: Yellow filter layer | |
| Yellow colloidal silver | 0.10 |
| Anti-color staining agent SC-1 | 0.10 |
| High boiling solvent Oil-2 | 0.10 |
| Gelatin | 1.00 |
| Layer 9: Low speed blue-sensitive emulsion layer | |
| Silver iodobromide emulsion Em-3 (average grain size 0.27 μm, average silver iodide content 8 mol %) | 0.50 |
| Sensitizing dye SD-6 | $7.0 \times 10^{-4}$ |
| Yellow coupler Y-1 | 0.40 |
| Yellow coupler Y-2 | 0.30 |
| DIR compound DD-2 | 0.005 |
| High boiling solvent Oil-2 | 0.10 |
| Gelatin | 0.90 |
| Layer 10: High speed blue-sensitive emulsion layer | |
| Silver iodobromide emulsion (average grain size 0.38 μm, average silver iodide content 7 mol %) | 0.65 |
| Sensitizing dye SD-6 | $6.0 \times 10^{-4}$ |
| Yellow coupler Y-1 | 0.20 |
| High boiling solvent Oil-2 | 0.08 |
| Gelatin | 0.55 |
| Layer 11: First protective layer | |
| Fine grains of silver iodobromide emulsion (average grain size 0.08 μm) | 0.40 |
| UV absorbent UV-1 | 0.07 |
| UV absorbent UV-2 | 0.10 |
| High boiling solvent Oil-1 | 0.07 |
| High boiling solvent Oil-3 | 0.07 |
| Gelatin | 0.60 |
| Layer 12: Second protective layer | |
| Alkali-soluble matting agent (average grain size 2 μm) | 0.15 |
| Polymethyl methacrylate (average grain size 3 μm) | 0.04 |
| Lubricant WAX-1 | 0.04 |
| Gelatin | 0.60 |

C-1

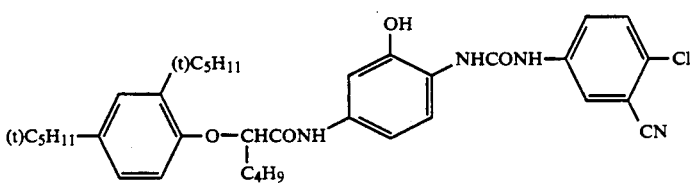

M-1

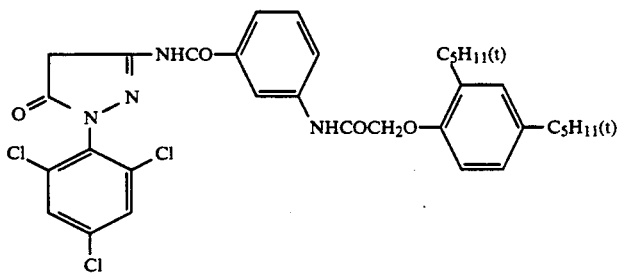

-continued
Y-1
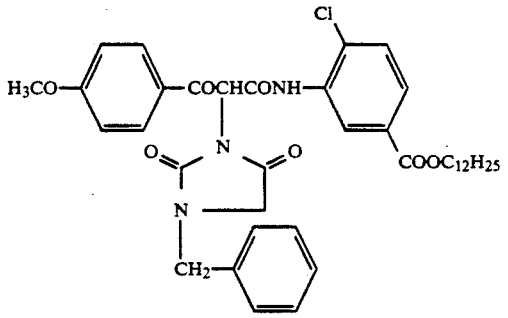
Y-2
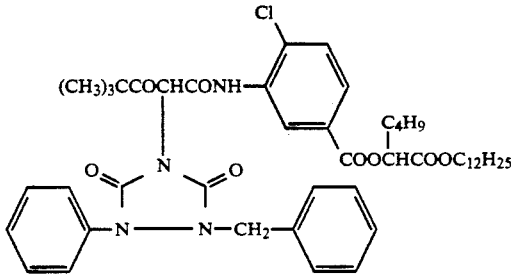
CC-1
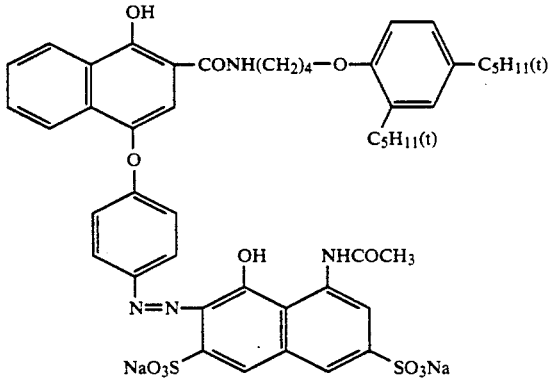
CM-1
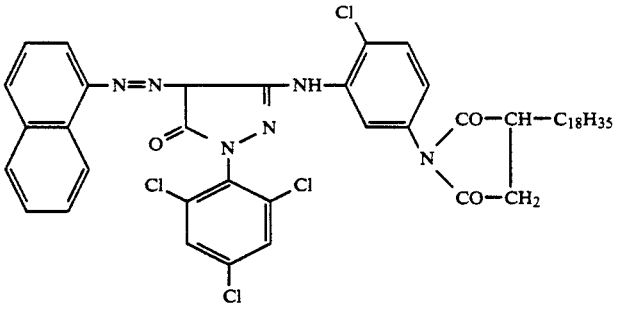
CM-2
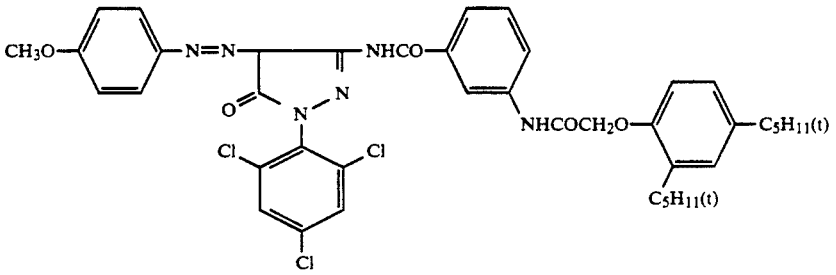

-continued
DD-1
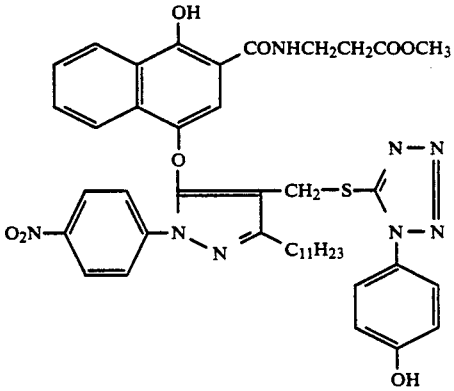
DD-2
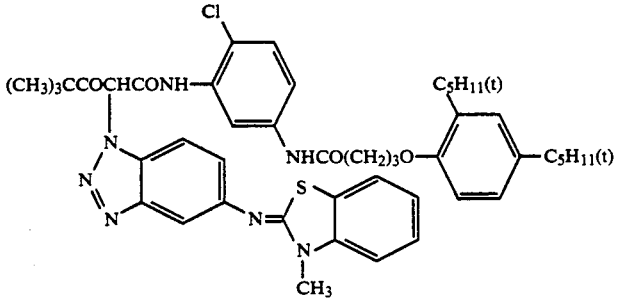
Oil-1
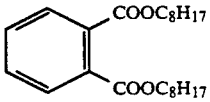
Oil-2
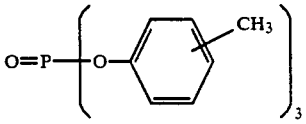
Oil-3
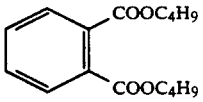
SC-1
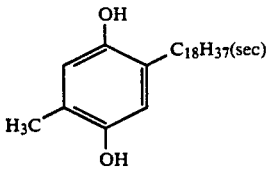
UV-1
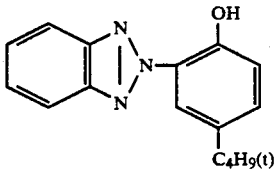
UV-2
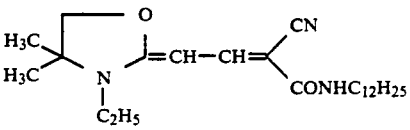

-continued
WAX-1
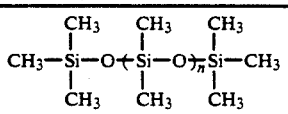
Weight average molecular weight Mw = 3,000
SD-1
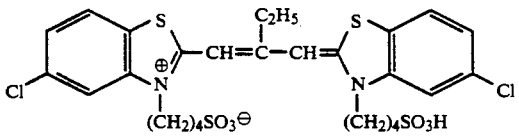
SD-2
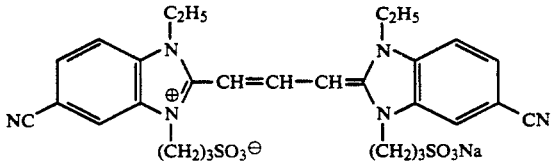
SD-3
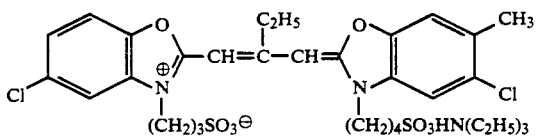
SD-4
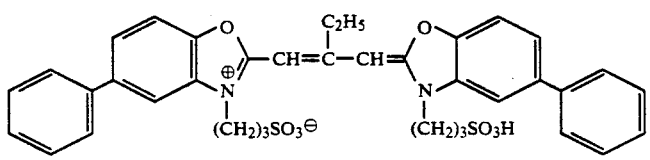
SD-5
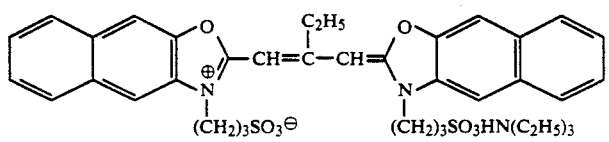
SD-6
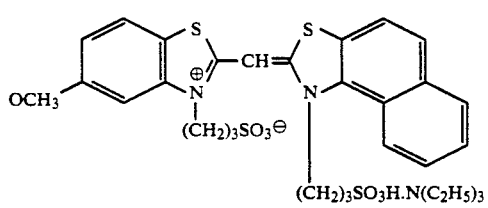
In addition to these compositions, a coating aid Su-1, a dispersing agent Su-2, a viscosity regulator, hardeners H-1 and H-2, a stabilizer ST-1, an antifogging agent AF-1 and two kinds of AF-2 having an average molecular weight of 100,000 or 1,100,000, respectively, were added.
Su-1
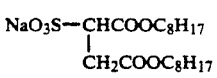
Su-2
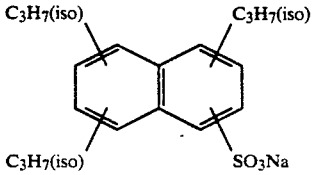
-continued
H-1
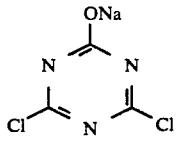
H-2
$(CH_2{=}CHSO_2CH_2)_2O$
ST-1
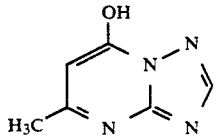

-continued

AF-1

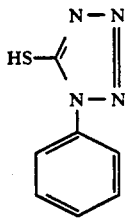

AF-2

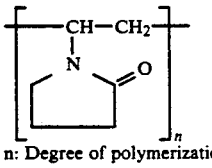

n: Degree of polymerization

Next, sample Nos. 102 through 107 were prepared in the same manner as with sample No. 101 except that the silver iodobromide emulsions and sensitizing dyes in the blue-sensitive layer were changed as shown in Table 2 and a cyan dye forming coupler was added, and that the amount of silver in layer 9 and the amounts of coating in layers 3 and 6 were changed as shown in Table 1 for some sample.

Em-5

Silver iodobromide emulsion comprising grains having an average grain size of 0.27 μm and an average silver iodide content of 4 mol %.

Em-6

Silver iodobromide emulsion comprising grains having an average grain size of 0.45 μm and an average silver iodide content of 6 mol %.

Em-7

Silver iodobromide emulsion comprising grains having an average grain size of 0.32 μm and an average silver iodide content of 2.5 mol %.

The sample Nos. 101 through 107 thus prepared were exposed to white light through an optical wedge, followed by the color developing process described below. All samples gave similar sensitometric results.

Next, these samples were shaped so that they could be photographed using a camera, after which the BG (blue-green), G (green), YG (yellow-green), Y (yellow), OR (orange) and BS (blue-sky) colors of the Macbeth color chart and a piece of blue-green cloth were photographed using these samples.

| Processing procedures (38° C.) | |
|---|---|
| Color development | 3 minutes 10 seconds |
| Bleaching | 6 minutes 30 seconds |
| Washing | 3 minutes 15 seconds |
| Fixation | 6 minutes 30 seconds |
| Washing | 3 minutes 15 seconds |
| Stabilization | 1 minute 30 seconds |
| Drying | |

The processing solutions used in the respective processing procedures had the following compositions:

| | |
|---|---|
| Color developer | |
| 4-amino-3-methyl-N-ethyl-N-(β-hydroxyethyl)aniline sulfate | 4.75 g |
| Anhydrous sodium sulfite | 4.25 g |
| Hydroxylamine ½ sulfate | 2.0 g |
| Anhydrous potassium carbonate | 37.5 g |
| Sodium bromide | 1.3 g |
| Trisodium nitrilotriacetate monohydrate | 2.5 g |
| Potassium hydroxide | 1.0 g |
| Water was added to make a total quantity of 1 l (pH = 10.1) | |
| Bleacher | |
| Iron (III) ammonium ethylenediaminetetraacetate | 100.0 g |
| Diammonium ethylenediaminetetraacetate | 10.0 g |
| Ammonium bromide | 150.0 g |
| Glacial acetic acid | 10.0 ml |
| Water was added to make a total quantity of 1 l, and aqueous ammonia was added to obtain a pH of 6.0. | |
| Fixer | |
| Ammonium thiosulfate | 175.0 g |
| Anhydrous sodium sulfite | 8.5 g |
| Sodium metasulfite | 2.3 g |
| Water was added to make a total quantity of 1 l, and acetic acid was added to obtain a pH of 6.0. | |
| Stabilizer | |
| Formalin (37% aqueous solution) | 1.5 ml |
| Konidax (produced by Konica Corporation) | 7.5 ml |
| Water was added to make a total quantity of 1 l. | |

From the developed films thus obtained, images were printed on color paper (Konica Color PC Paper type SR) so that gray of an optical density of 0.7 was reproduced into the same density, and the reproducibility in each sample was evaluated. Results are given in Table 5 below.

From the spectral sensitivity distribution at an image density of minimum density +0.7, comparisons were made of the maximum sensitivity at an image density of minimum density +0.7 in the spectral sensitivity distribution in the blue-sensitive layer (hereinafter referred to as maximum sensitivity) and the spectral sensitivity at 480 nm for an image density of minimum sensitivity +0.7 (hereinafter referred to as the sensitivity at 480 nm). For sensitivity comparison, the following equation was used.

$$\frac{\text{Sensitivity at 480 nm}}{\text{maximum sensitivity}} \times 100\ (\%)$$

The results of evaluation as to the these two items are given in Table 4. In Table 4, the wavelength which provided the maximum spectral speed for the blue-sensitive layer at an image density of minimum density +0.7 is shown in the column for maximum sensitivity wavelength.

TABLE 4

| Sample number (inventive/comparative) | Layer 9 blue-sensitive emulsion layer: Silver iodobromide emulsion Kind | Amount (g/m²) | Sensitizing dye | Cyan dye forming coupler Kind | Amount (g/m²) | Layer 10 blue-sensitive emulsion layer: Silver iodobromide emulsion Kind | Sensitizing dye | Amount of coating relative to sample No. 101 | Judgement: Maximum sensitivity wavelength (nm) | Ratio of sensitivity at 480 nm to maximum sensitivity |
|---|---|---|---|---|---|---|---|---|---|---|
| 101 (comparative) | Em-3 | 0.50 | SD-6 | — | — | EM-4 | SD-6 | — | 480 | 100% |
| 102 (comparative) | Em-3 | 0.50 | A-7 | — | — | EM-4 | A-7 | — | 460 | 50% |
| 103 (comparative) | EM-5 | 0.50 | A-7 | — | — | EM-6 | A-7 | — | 455 | 34% |
| 104 (comparative) | Em-3 | 0.53 | A-7 | $C_4$-20<br>$C_D$-11 | 0.01<br>0.01 | EM-4 | A-7 | Amount of coating for layer 3 = 0.9 time<br>Amount of coating for layer 6 = 1.05 times | 460 | 50% |
| 105 (inventive) | Em-5 | 0.53 | A-7 | $C_4$-20<br>$C_D$-11 | 0.01<br>0.01 | Em-6 | A-7 | Amount of coating for layer 3 = 0.9 time<br>Amount of coating for layer 6 = 1.05 times | 455 | 33% |
| 106 (inventive) | Em-5 | 0.56 | A-7 | $C_4$-20<br>$C_D$-11 | 0.01<br>0.02 | Em-6 | A-7 | Amount of coating for layer 3 = 0.85 time<br>Amount of coating for layer 6 = 1.1 times | 455 | 33% |
| 107 (inventive) | Em-7 | 0.62 | A-7 | $C_D$-11 | 0.04 | Em-6 | A-7 | Amount of coating for layer 3 = 0.85 time<br>Amount of coating for layer 6 = 1.2 times | 455 | 24% |

TABLE 5

| Sample number (inventive/comparative) | Cloth | BG (blue-green) | (green) | YG (yellow-green) | Y (yellow) | BS (blue-sky) | OR (orange) |
|---|---|---|---|---|---|---|---|
| 101 (comparative) | D | D | C | D | C | C | C |
| 102 (comparative) | C | C | C | C | C | C | C |
| 103 (comparative) | B | B | B | C | C | C | B |
| 104 (comparative) | C | C | B | B | B | C | B |
| 105 (inventive) | B | B | B | B | B | B | B |
| 106 (inventive) | B | B | A | B | A | B | B |
| 107 (inventive) | A | A | A | A | A | B | B |

Hue reproduction was evaluated by visual observation for a peice of blue-green cloth and some colors of the Macbeth color chart. The evaluation criteria are as follows:
A: Very good.
B: Good.
C: Unsatisfactory.
D: Evidently poor.

As seen in Table 5, with respect to sample Nos. 105 through 107 prepared in accordance with the present invention, improvements were obtained not only in the hues for the blue-green color of the cloth and for the BG and G colors of the Macbeth color chart but also in the hues for the YG and Y colors. On the other hand, none of the comparative sample Nos. 101 through 104 reproduced any of the hues for the BG, G, YG and Y colors of the Macbeth color chart into nearly the same hues as of the original colors.

Also, sample Nos. 106 and 107 gave satisfactory results in terms of color purity for the G and Y colors; particularly sample No. 107 offered perfect color reproduction for every color.

It has also been found that with respect to the hues for the BS and DR colors of the Macbeth color chart, satisfactory improvements can be obtained with the constitution of the present invention.

What is claimed is:

1. A silver halide photographic light-sensitive material comprising a support having provided thereon a red-sensitive silver halide emulsion layer containing a cyan dye-forming coupler, a green-sensitive silver halide emulsion layer containing a magenta dye-forming coupler, and a blue-sensitive silver halide emulsion layer containing a yellow dye-forming coupler, wherein said blue-sensitive silver halide emulsion layer has a maximum spectral sensitivity at a wavelength of 415 nm to 470 nm, a spectral sensitivity of said blue-sensitive emulsion layer at 480 nm being not more than 35% of said maximum spectral sensitivity, maximum spectral sensitivity and said specrtral sensitivity at 480 nm being determined based on a reciprocal of an amount of light necessary to form an image having a density 0.7 times higher than the minimum density of said blue-sensitive emulsion layer, said blue-sensitive emulsion layer further containing a cyan dye-forming DIR coupler capable of releasing a development inhibitor or its precursor, said development inhibitor or said precursor having a diffusibility of 0.34 to 0.60.

2. The light-sensitive material of claim 1 wherein said cyan dye-forming DIR coupler is contained in said blue-sensitive silver halide emulsion layer in an amount of from 0.04 g/m$^2$ to 0.10 g/m$^2$.

3. The light-sensitive material of claim 1, wherein said cyan dye-forming DIR coupler is a compound represented by one of Formula CII, CIII, or CIV;

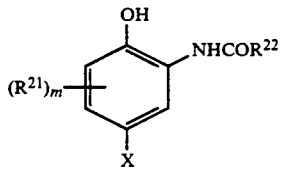

(CII)

-continued

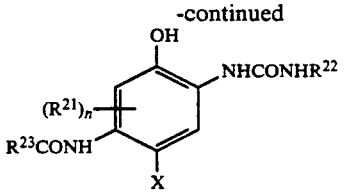

(CIII)

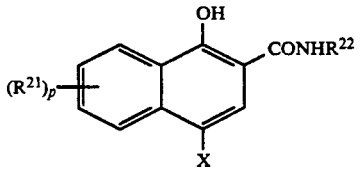

(CIV)

wherein $R^{21}$, $R^{22}$, and $R^{23}$ are each a substituent; m is an integer of 0 to 3, n is an integer of 0 to 2, and p is an integer of 0 to 5; with a proviso that, when m, n or p is an integer of 2 or more, said $R^{21}$'s may be the same or different; X is a substituent capable of splitting off upon reaction with the oxidation product of a primary aromatic amine-type color developing agent to form a development inhibitor or a group capable of releasing a developer inhibitor, said developer inhibitor having a diffusibility of 0.34 to 0.60.

* * * * *